United States Patent [19]

Appel et al.

[11] 4,310,031

[45] Jan. 12, 1982

[54] APPARATUS FOR FANNING OUT WIRE COILS

[75] Inventors: Manfred Appel, Kempen; Jörn Moslener, Düsseldorf; Karl-Heinz Spiecker, Duisburg, all of Fed. Rep. of Germany

[73] Assignee: Mannesmann DeMag AG, Duisburg, Fed. Rep. of Germany

[21] Appl. No.: 61,516

[22] Filed: Jul. 27, 1979

[30] Foreign Application Priority Data

Sep. 1, 1978 [DE] Fed. Rep. of Germany ..... 2838155

[51] Int. Cl.[3] ..... C21D 9/56

[52] U.S. Cl. ..... 140/2; 198/339; 72/201; 72/127; 266/106

[58] Field of Search ..... 266/106; 140/2; 198/339; 72/201, 127

[56] References Cited

U.S. PATENT DOCUMENTS 4,056,186 11/1977 Hill ..... 198/339

4,064,916 12/1977 Dahmen ..... 140/2

FOREIGN PATENT DOCUMENTS 2038747 8/1970 Fed. Rep. of Germany .

*Primary Examiner*—Peter D. Rosenberg

*Attorney, Agent, or Firm*—Mandeville and Schweitzer

[57] ABSTRACT

Apparatus is provided for laying out and evenly distributing the coils of severed hot strands of wire emerging from a rolling mill. In order to maintain the line in continuous operation and in order to distribute the severed cooled strands to the subsequent bundling apparatus, the arrangement herein provides for dual conveyors each preceded by its own laying tube and a switch for selectively feeding the strands to one or other of the conveyors. By controlling the speed of one relative to the other of the dual conveyors, the strands may be selectively converged in even distribution for subsequent processing. The dual conveyors may be side by side or superimposed one above the other. With the latter arrangement, the upper conveyor may be mounted to pivot into and out of the line of the lower conveyor for the sequential feeding of the coils to the following line.

4 Claims, 2 Drawing Figures

APPARATUS FOR FANNING OUT WIRE COILS

BACKGROUND AND STATEMENT OF THE INVENTION

The invention refers to an apparatus for fanning out and evenly distributing wire coils continuously emerging from a rolling mill onto a conveyor arranged following a laying apparatus for putting the coils in place with a rotating laying tube. The conveyor is succeeded by a collecting station for the wire coils in bundles. The laying apparatus is preceeded by a cutting apparatus for the incoming wire.

Installations of this kind are used for cooling, or for heat treatment of the hot wire coming from the rolling mill, whereby the conveyor is generally constructed so that a heat treatment medium, such as air, may pass through the fanned-out wire coils, as well as the conveyor conveying the wire.

The mill operator endeavors, essentially, to charge billets of great weight, if possible, in order to produce a high yield. Furthermore, part of the wire-processing industry has a decided interest in wire bundles of heavy weight. At the same time, there exists a demand for wire bundles of low weight for further use of existing processing plants. The demand for wire bundles of low weight is covered by subdividing the wire.

It is already known to have a cutting device, such as shears, precede the laying apparatus subdividing the arriving hot wire strand (DE-OS 20 38 747). This device, however, is only suitable for the cutting off of the head or starting pieces which, immediately after having been deposited onto the conveyor, must be removed by hand, because removal in the subsequent bundle formation chamber at the end of the conveyor can only be done with unreasonably great expenditure. This kind of removal is dangerous not only because the hot divided coils, after fanning out onto the conveyor, are still superimposed and thus entwined, but also because it is time-consuming and disturbs the otherwise continuous and automatic process of fanning out and forming bundles.

The subdivision into small bundles was heretofore usually done within the bundle formation chamber, and to this end a gripper device was introduced into the path of the coils to be collected, while simultaneously retaining successive coils, in order to feed the wire thus isolated to a cutting device. However, this method represents always a considerable source of disturbance in the otherwise continuous process, as the wires, being of different thickness and strength, behave very differently.

Based on this, the invention is intended to improve the apparatus to fan out wire coils so that when severing the wire before entrance into the laying apparatus, disturbance-free automatic severance and removal of the severed wire coils and/or bundles is possible even at high wire rolling speeds. This is achieved by providing, two convergent speed-controlled conveyors, each with a coordinated laying apparatus, which precede one shared conveyor.

Thus, the continuously arriving wire strands may be fed to one or the other of the two laying devices and their coordinated conveyors by means of a switch coordinated with the cutting apparatus, while one of the conveyors is set for a lower speed than the other conveyor. The slower speed causes a tighter coil placement and at the same time a delay in the transfer of the succeeding wire strand to the shared conveyor, so that there is spacing between the coils of the preceding and succeeding wire strands. This distance is necessary and sufficient to remove the bundle from the preceding wire strand at the end of the shared conveyor in the bundle formation chamber before the next bundle is formed.

Another considerable advantage of the proposed apparatus is that the dual laying apparatus makes available at the same time a substitute laying apparatus so that in case of disturbance or maintenance work it is still possible to work in the conventional manner with the remaining laying apparatus.

Furthermore, it must be stressed that this invention makes it possible to roll endlessly, for example by means of welding together the charged billets, since subdivision into the desired bundle weights is possible at any desired location. Preferably, the laying devices are arranged side by side with the converging conveyors in a horizontal plane. However, the laying devices may be superimposed one above the other. The following conveyors are then superimposed in such a way that a passage remains between the upper and the lower conveyor for the wire coils transported on the lower conveyor. In this proposal, the wire coils transported on the upper conveyor bridge the distance between the upper and lower conveyor in a free fall.

The laying devices may be superimposed, according to the invention, and the converging conveyors are superimposed in such a way that at least one of the conveyors pivots around a pivot point into the plane of the shared conveyor and back again. With this arrangement, for example, one of the conveyors may be linguiform, whereby the tongue is always raised when the other conveyor transports the wire coils to the shared conveyor, and is lowered when the wire coil end has passed the range of the first conveyor.

Examples of the invention are shown on the drawing and are explained as follows:

DETAILED DESCRIPTION OF THE INVENTION

Figure 1:
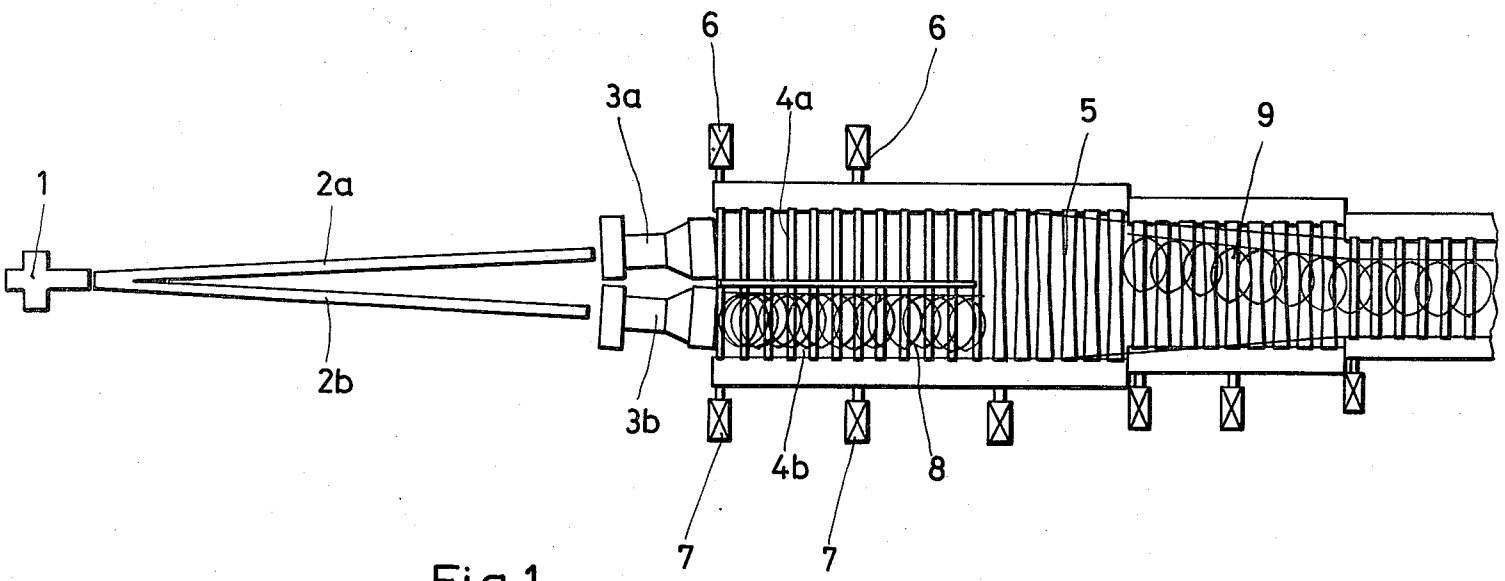
FIG. 1 is a top plan view of apparatus illustrating the invention for fanning out wire coils with two side-by-side laying devices.

1 in FIG. 1 stands for the switch following the cutting device, not shown, feeding the hot wire arriving from the last rolling stand to the two cooling lines 2*a* and 2*b*. At the end of the two cooling lines, one laying apparatus each, 3*a* and 3*b* respectively, is provided depositing the wire in known fashion by means of a rotating laying tube onto the succeeding conveyors 4*a* and 4*b*. The conveyors 4*a* and 4*b* converge towards the shared conveyor 5 preceding the bundle formation chamber, also not shown, at the end of conveyor 5.

The installation proposed by the invention functions in such a way that the arriving wire strand section is, for example, fed to the conveyor 4*a* driven by means of the drive motors 6 at uniform speed, via laying apparatus 3*a*. The wire coils forming while the wire is being deposited onto the conveyor are evenly transported to conveyor 5. After shifting switch 1 following the cutting procedure in the cutting apparatus which is not illustrated, the wire strand section runs through cooling line 2b, and is deposited on conveyor 4b by laying apparatus 3b. This conveyor, automatically driven by means of drive motors 7 runs at a lower speed than conveyor 4a which, on one hand causes the wire to be deposited in tighter coils and, on the other hand, entails a distance between the wire coils resting on conveyor 4b and marked 8, and the wire coils resting on conveyor 5 and marked 9. This distance facilitates disturbance-free removal of the coils 9 collected into bundles in the bundle formation chamber before the coils 8 of the successive wire strand section enter into the bundle formation chamber. In case of disturbance or repair work involving one of the laying devices 3a, 3b, it is possible to continue operating the apparatus in the conventional way by means of the remaining laying apparatus.

Figure 2:
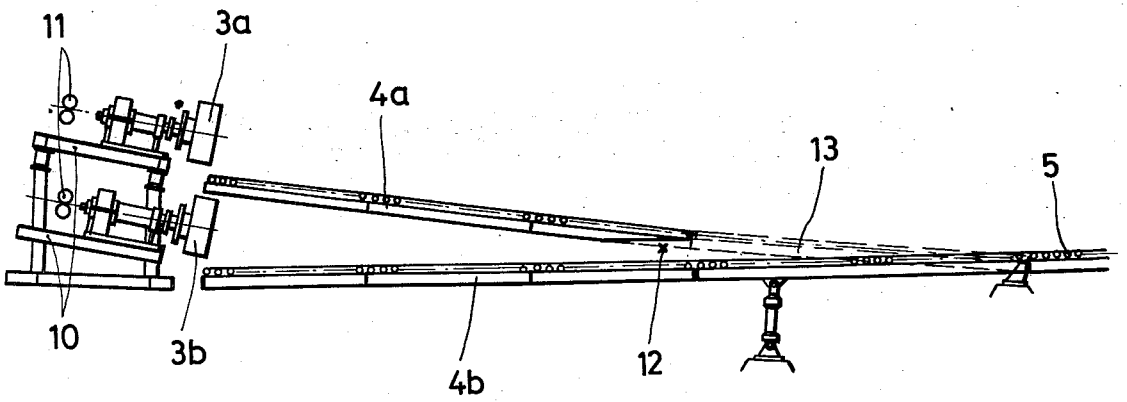
FIG. 2 is a side elevational view of apparatus illustrating the invention with two superimposed laying devices.

FIG. 2 also shows two laying devices 3a, 3b which are arranged in superimposed fashion by means of a stand 10. The laying devices 3a, 3b are preceded by additional drivers 11. However, the latter are independent of the present invention. In this example, the converging conveyors 4a and 4b are arranged superimposed, whereby a free space 12 remains between conveyor 4a and 4b, through which the wire coils deposited on conveyor 4b may pass. As soon as the wire fed to laying apparatus 3a, after having been severed, has been deposited on conveyor 4a, and the wire fanned out on conveyor 4b has passed the space 12 between conveyors 4a, 4b, a passage can be created between the shared conveyor 5 and conveyor 4a by pivoting or swinging up one part of conveyor 4a located between the rollers of conveyor 4b, marked 13 in FIG. 2. Through this passage the wire coils may be transferred smoothly from conveyor 4a to conveyor 5. However, conveyor 4a may be pivoted on the laying apparatus 3a area around a horizontal axis, and the lower end of conveyor 4a facing space 12 may be lowered to conveyor 4b in the manner of a tongue.

In both examples, the conveyors 4a, 4b may be variable in speed so that they may be slowed down in alternating fashion, which is required for continuous operation with the two laying devices 3a, 3b. After creating, in this way, the necessary distance between coils 8 and 9, the respective conveyors may be adapted to the removal speed of conveyor 5. This leaves only a short area at the beginning of the fanned-out coils with tight coil placement. The remaining coils may be fanned out optimally.

We claim:

1. In an apparatus for fanning out wire coils continuously emerging from a wire mill and including severing means, laying means for forming the wire into coils, conveyor means for advancing the coiled wire in fanned-out form, to a bundling station, the improvement characterized by (a) said conveyor means including a common conveyor, for the delivery of fanned-out coils to said bundling station, and first and second separate feed conveyors for the delivery of fanned-out coils to said common conveyor, (b) said severing means and laying means cooperating for the deposit of alternate successive coils on the respective feed conveyors, (c) individual, speed controllable drives for said feed conveyors, whereby either one of said feed conveyors may be temporarily driven slower than the other, during the period when a coil is being deposited on said one feed conveyor, to provide a space between successive coils on said common conveyor.

2. The apparatus of claim 1, further characterized by (a) said feed conveyors being mounted in the same horizontal plane; and (b) said laying means comprising separate rotating laying tubes for each feed conveyor positioned in side by side relation.

3. The apparatus of claim 1, further characterized by (a) said laying means comprising separate rotating laying tubes for each feed conveyor positioned one above the other;

(b) said feed conveyors being superimposed one above the other; and (c) the upper feed conveyor being spaced sufficiently above the lower feed conveyor to provide a passage for coiled strands on said lower feed conveyor.

4. The apparatus of claim 3, further characterized by (a) said upper feed conveyor being mounted to pivot into and out of a path of convergence with said lower feed conveyor.

* * * * *